US006782774B2

(12) United States Patent
Ito et al.

(10) Patent No.: US 6,782,774 B2
(45) Date of Patent: Aug. 31, 2004

(54) PEDAL APPARATUS FOR AUTOMOBILE

(75) Inventors: Sadao Ito, Anjo (JP); Hiroshi Watanabe, Aichi-ken (JP); Takashi Ishii, Toyota (JP); Soshi Mitsuyama, Toyota (JP)

(73) Assignees: Aisin Seiki Kabushiki Kaisha, Kariya (JP); Toyota Jidosha Kabushiki Kaisha, Toyota (JP)

( * ) Notice: Subject to any disclaimer, the term of this patent is extended or adjusted under 35 U.S.C. 154(b) by 4 days.

(21) Appl. No.: 09/924,478

(22) Filed: Aug. 9, 2001

(65) Prior Publication Data

US 2002/0020251 A1 Feb. 21, 2002

(30) Foreign Application Priority Data

Aug. 11, 2000 (JP) ..... P. 2000-245149

(51) Int. Cl.[7] ..... G05G 1/04
(52) U.S. Cl. ..... 74/512
(58) Field of Search ..... 74/512, 560

(56) References Cited

U.S. PATENT DOCUMENTS

| | | | | | |
|---|---|---|---|---|---|
| 3,643,524 | A | * | 2/1972 | Herring | 74/512 |
| 3,643,525 | A | | 2/1972 | Gibas | 74/512 |
| 3,691,868 | A | * | 9/1972 | Smith | 74/512 |
| 3,754,480 | A | * | 8/1973 | Bodnar et al. | 74/512 |
| 3,828,625 | A | * | 8/1974 | Bruhn, Jr. | 74/512 |
| 4,870,871 | A | * | 10/1989 | Ivan | 74/513 |
| 5,172,606 | A | * | 12/1992 | Dzioba et al. | 74/512 |
| 6,151,984 | A | * | 11/2000 | Johansson et al. | 74/512 |
| 6,173,625 | B1 | * | 1/2001 | McFarlane et al. | 74/512 |
| 6,352,007 | B1 | * | 3/2002 | Zhang et al. | 74/512 |

FOREIGN PATENT DOCUMENTS

| | | | | |
|---|---|---|---|---|
| GB | 2072595 A | * | 10/1981 | G05G/11/00 |
| JP | 51-22218 | | 7/1974 | |
| JP | 52-44985 | | 7/1974 | |

* cited by examiner

*Primary Examiner*—Chong H. Kim
(74) *Attorney, Agent, or Firm*—Finnegan, Henderson, Farabow, Garrett & Dunner, L.L.P.

(57) ABSTRACT

A pedal apparatus for an automobile comprises a plurality of pedals attached to a bracket fixed to a vehicle body via a plurality of parallel link mechanisms, a connection parallel link mechanism that connects a pair of the plurality of parallel link mechanism, and is provided with a pair of connection portions connecting the both parallel link mechanisms with the bracket, and an adjustment mechanism attached to the bracket, that arbitrarily prescribes the forms of each parallel link mechanism and the connection parallel link mechanism.

10 Claims, 5 Drawing Sheets

PEDAL APPARATUS FOR AUTOMOBILE

INCORPORATION BY REFERENCE

The disclosure of Japanese Patent Application No. 2000-245149 filed on Aug. 11, 2001 including the specification, drawings and abstract is incorporated herein by reference in its entirety.

BACKGROUND OF THE INVENTION

1. Field of the Invention

The invention relates to a pedal apparatus for an automobile, more particularly to a pedal apparatus for an automobile that can adjust initial positions of a plurality of pedals.

2. Description of Related Art

An example of a pedal apparatus for an automobile is disclosed in Japanese Utility Model Application Laid Open No. 51-22213. The pedal apparatus shown in the above laid-open application comprises a pedal (i.e. a brake pedal) attached to a bracket fixed to a vehicle body via a parallel link mechanism and an adjustment mechanism attached to the bracket for arbitrarily prescribing the form of the parallel link mechanism. In this pedal apparatus, an initial position of the brake pedal can be adjusted by adjustment operation by means of the adjustment mechanism.

In the pedal apparatus in the aforementioned application, a plurality of parallel link mechanisms are coaxially disposed at a connecting portion of the bracket, whereby a plurality of pedals are attached to the bracket via each parallel link mechanism. However, when a different value is set for the angle of depressing direction for each pedal (i.e. the operation feeling is set optimally for each pedal), a length of each pedal and a link length of each parallel mechanism need to be varied. In this case, if an initial position for each pedal is adjusted by adjustment operation by means of the adjustment mechanism, an adjustment stroke for each pedal and a relative position of each pedal are changed, and the adjustment stroke for each pedal cannot be made identical.

In addition, in the pedal apparatus in the aforementioned application, two stoppers that are attached to the bracket prescribe an allowable rotational range of an operation lever rotatably operated by the pedal. Therefore, cost is increased when respective stoppers are employed for a plurality of pedals. Further, in the pedal apparatus in the aforementioned application, to increase rigidity in the direction of plate thickness of the operation lever, the plate thickness of the operation lever itself needs to be made larger, thereby increasing weight and cost.

SUMMARY OF THE INVENTION

In order to solve the aforementioned problems, a pedal apparatus for an automobile according to the first aspect of the invention comprises a plurality of pedals each of which is attached to a bracket fixed to a vehicle body via a plurality of parallel link mechanisms, a connection parallel link mechanism that connects a pair of plurality of parallel link mechanisms, and is provided with a pair of connection portions connecting the both parallel link mechanisms with the bracket, and an adjustment mechanism that is attached to the bracket, and arbitrarily prescribes the form of each parallel link mechanism.

Based on this arrangement, at least one of the plurality of pedals may be an operation pedal, and the bracket may be provided with prescribing portion that prescribes an allowable rotational range of the operation lever rotatably operated by the pedal. The prescribing portion may comprise arc grooves provided in the operation lever centered with respect to the center of the rotational operation, and stopper pins fixed to the bracket and inserted into the arc grooves. Further, securing portions to prevent looseness in the direction of plate thickness of the operation lever may be provided at the head of the stopper pins.

In a pedal apparatus for an automobile according to the first aspect of the invention, the form of each parallel link mechanism can be arbitrarily adjusted and prescribed by adjustment operation by means of the adjustment mechanism, and initial positions of a plurality of pedals can be adjusted simultaneously. In the mean time, a pair of a plurality of parallel link mechanisms for attaching a plurality of pedals respectively to the bracket are connected together at a connecting portion thereof to the bracket via a connection parallel link mechanism. Therefore, it is possible to set an angle in the depressing direction of each pedal by setting each portions to the optimal dimensions (i.e. to optimize the operation feeling of each pedal), as well as to make the adjustment strokes for the pedals which are adjusted simultaneously shall be identical (i.e. distance between both pedals is not changed).

In addition, there are some cases in which the invention is embodied in a form wherein at least one of the plurality of pedals is an operation pedal and the allowable rotational range of the operation lever rotatably operated by the operation pedal is prescribed by arc grooves centered with respect to the rotational operation center provided in the operation lever, and stopper pins fixed to the bracket and inserted into the arc grooves. In this case, the allowable rotational range of the operation lever (i.e. operation stroke of the pedal) can be prescribed by one piece of the stopper pins, and thus the cost is low.

In addition, in some cases the invention is embodied by providing securing portions to prevent looseness in the direction of plate thickness of the operation lever at the head portions of the stopper pins. In this case, the securing portion to prevent looseness can restrict movement of the operation lever in the direction of plate thickness of the operation lever, thereby increasing rigidity in that direction. Compared to when rigidity is increased in the direction of plate thickness of the operation lever by increasing the plate thickness of the operation lever itself, the weight and cost can be reduced further.

DETAILED DESCRIPTION OF PREFERRED EMBODIMENTS

Figure 1:
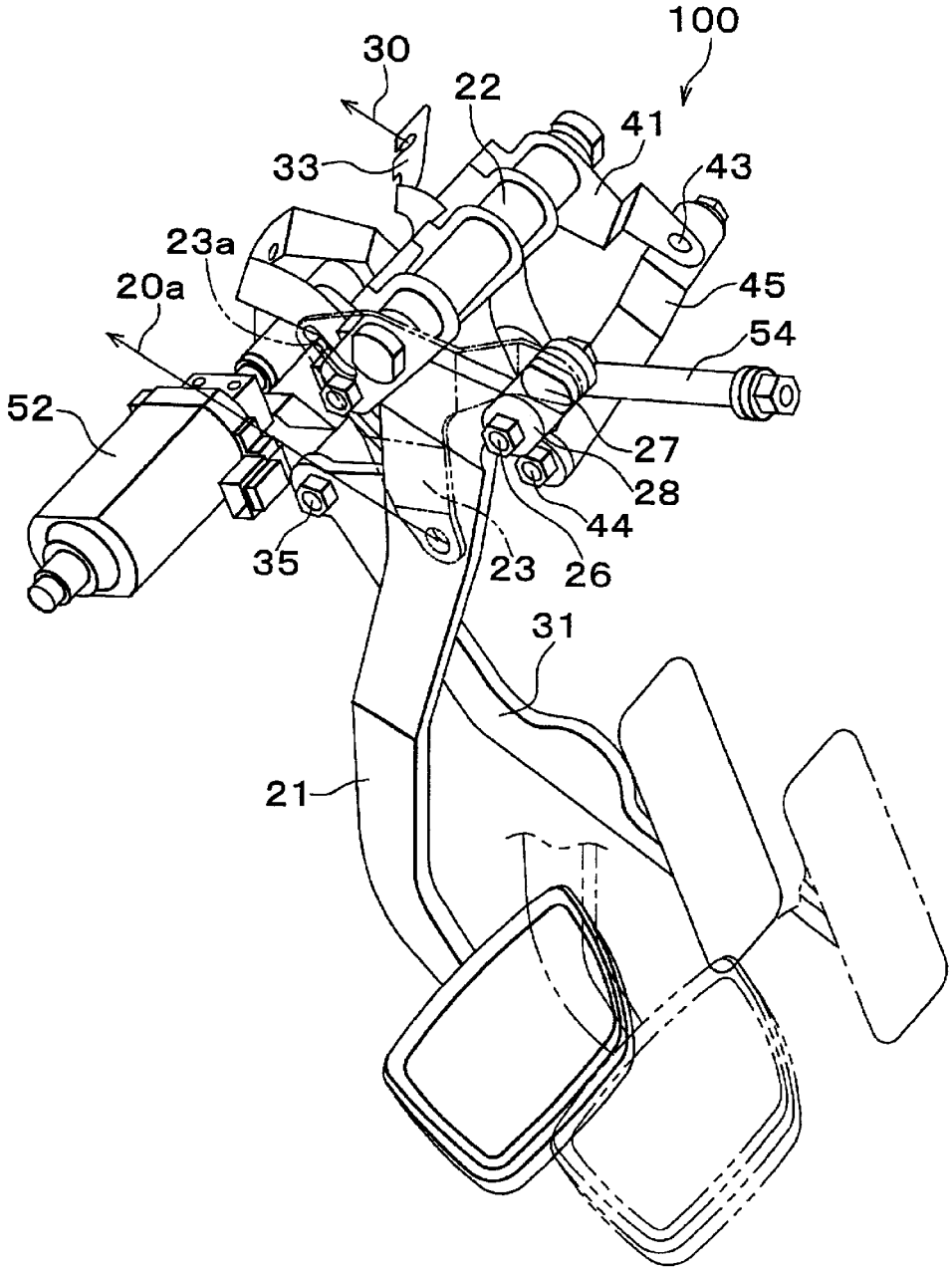
FIG. 1 is a perspective view showing an embodiment of a pedal apparatus for an automobile according to the invention.

Hereinafter, an embodiment of the invention is explained with reference to the drawings. In FIGS. 1 to 4, a pedal apparatus 100 for an automobile according to the invention is shown. This pedal apparatus 100 comprises a bracket 11 fixed to the vehicle body, a brake pedal 21, and an accelerator pedal 31. A parallel link mechanism A for a brake pedal is attached to the bracket 11 at a connection axial portion 22, and a parallel link mechanism B for an accelerator pedal is attached thereto at a connection axial portion 32. Further, the brake pedal 21 is attached to the bracket 11 via the parallel link mechanism A. The accelerator pedal 31 is attached to the bracket 11 via the parallel link mechanism B for acceleration. Further, the pedal apparatus 100 according to this embodiment comprises a connection parallel link mechanism C for connecting both parallel link mechanisms A, B. The connection parallel link mechanism C is provided with a pair of connection portions 22, 32 which connects the both parallel link mechanisms A, B with the bracket. And the pedal apparatus 100 also comprises an adjustment mechanism D attached to the bracket 11 for arbitrarily prescribing the forms of each of the parallel link mechanisms A, B, and C.

The parallel link mechanism A is provided with a brake pedal 21, an operation lever 23 for the brake pedal, an adjustment lever 24 for the brake pedal and a connection link 28. The operation lever 23 is rotatably attached to the bracket 11 via the connection axial portion 22. In addition, the adjustment lever 24 is rotatably attached to the bracket via the connection axial portion 22 at one end portion, with the other end portion swinging around the axial portion 22. Further, the brake pedal 21 is rotatably attached to the swinging portion (i.e. the other end portion) of the adjustment lever 24 via a connection pin 25. This brake pedal 21 and the operation lever 23 are rotatably connected to the connection link 28 by means of connection pins 26, 27, respectively.

The connection axial portion 22 is rotatably attached to the bracket 11. The operation lever 23 is rotatably attached to the connection axial portion 22, and connected to a push rod 20*a* of a brake master cylinder 20 via a connection pin 29. The adjustment lever 24 is fixed to the connection axial portion 22, and rotatably attached to the bracket 11 together with the connection axial portion 22. When the brake pedal 21 is depressed, the operation lever 23 is rotated around the connection axial portion 22, resulting in movement of the push rod in the axial direction of the brake cylinder 20.

The parallel link mechanism B in provided with an accelerator pedal, an operation lever 33 for the accelerator pedal, an adjustment lever 34 for the accelerator pedal, and a connection link 38. The operation lever 33 is rotatably attached to the bracket 11 via the connection axial portion 32. In addition, the adjustment lever 34 is rotatably attached to the bracket 11 via the connection axial portion 32 at one end, and with the other end swinging around the connection axial portion 32 by adjustment operation by means of an adjustment mechanism which will be described later. Further, the accelerator pedal 31 is rotatably attached to the swinging portion (i.e. the other end portion) of the adjustment lever 34 via a connection pin 35. This accelerator pedal 31 and the operation lever 33 are rotatably attached to a connection link 38 by means of connection pins 36, 37.

The connection axial portion 32 is rotatably attached to the bracket 11. The operation lever 33 is rotatably attached to the connection axial portion 32, and connected to an acceleration wire 30 via a connector 39. The adjustment lever 34 for acceleration is rotatably attached to the connection axial portion 32. By depressing the accelerator pedal 31, the operation lever is rotated centered with respect to the axial portion 32 so that the acceleration wire 30 is operated.

The connection parallel link mechanism C comprises a lever arm 41 fixed to the connection axial portion 22 and integrally rotated with the connection axial portion 22 and the adjustment lever 24 for a brake pedal, a lever arm 42 integrally formed with and rotated with the adjustment lever 34, and the connection link 45 rotatably attached to both lever arms 41, 42 via the connection pins 43, 44, respectively, such that the lever arm 41 and lever arm 42 are parallel each other.

The adjustment mechanism D comprises a motor 52 and gear box 53 for deceleration attached to the bracket 11 via a supporting bracket 51, a screw rod 54, a nut 55, and a lever arm 56. The screw rod 54 is rotatably and unmovably in the axial direction attached to the supporting bracket 51, and rotated by the motor 52 via the gear box 53. Further, the nut 55 is screwed onto the screw rod 54. In addition, the lever arm 56 is integrally formed with the lever arm 41 of the connection parallel link mechanism C, rotatably supporting the nut 55.

Figure 2:
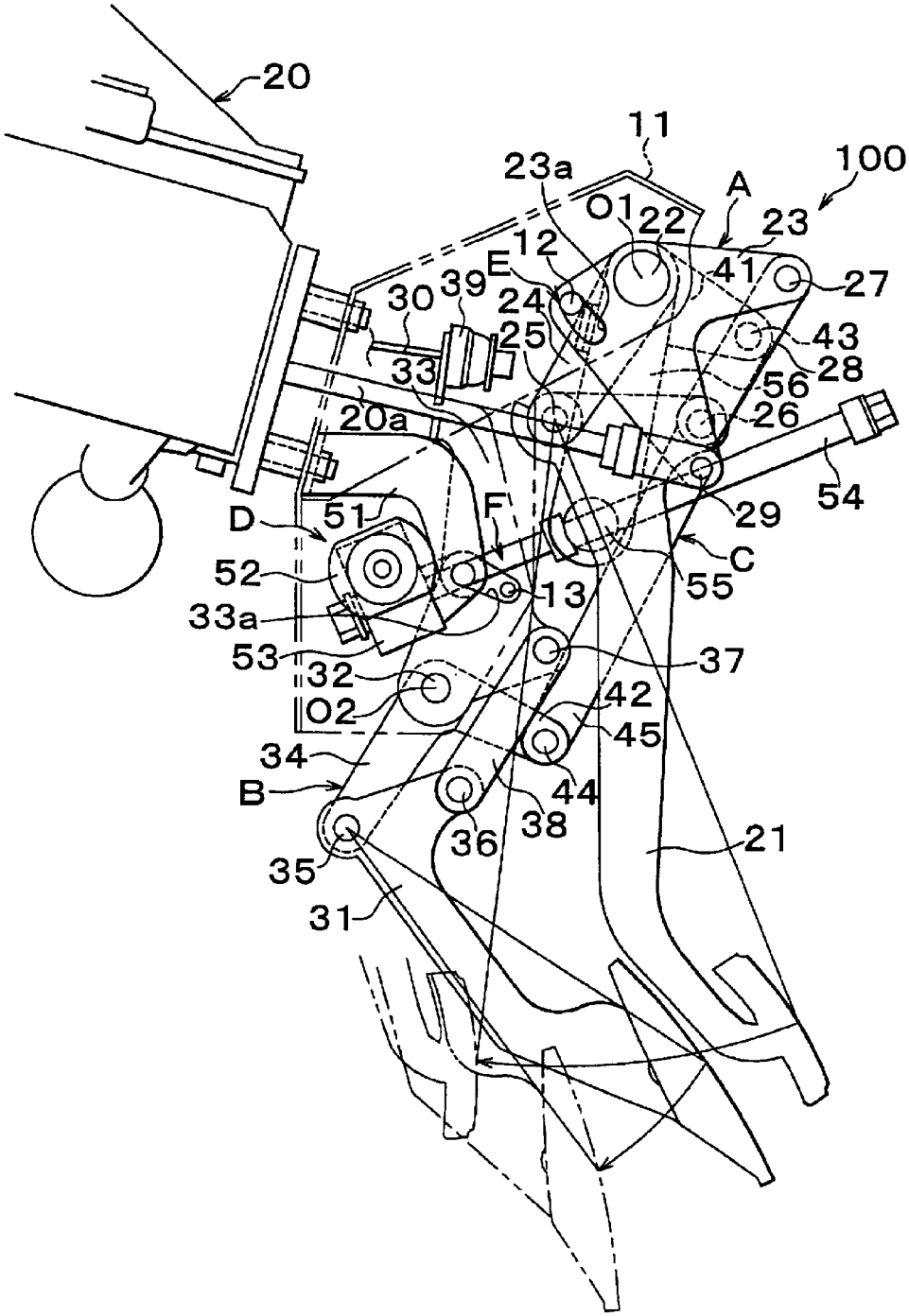
FIG. 2 is a side view of the pedal apparatus shown in FIG. 1.
Figure 4:
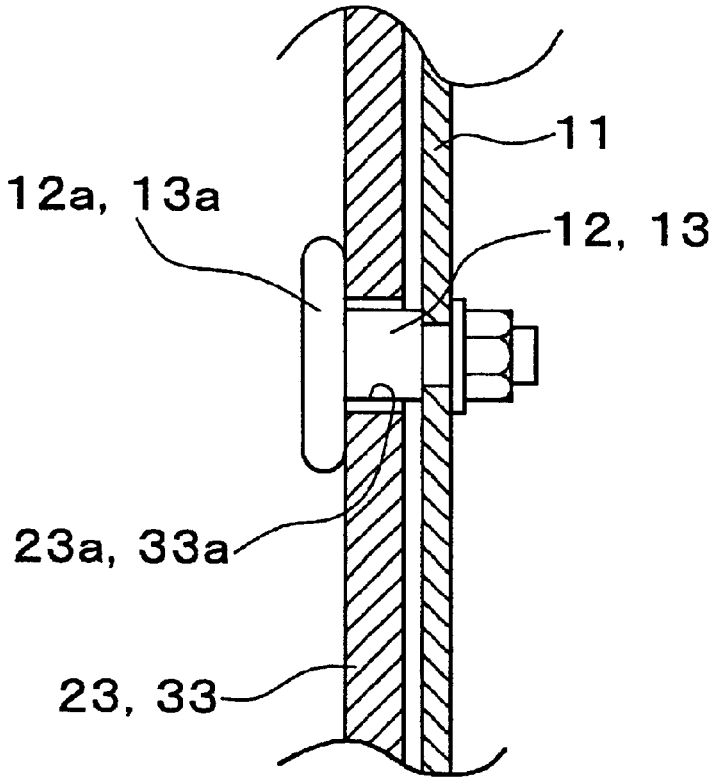
FIG. 4 is an enlarged sectional view of the stopper mechanism shown in FIG. 2.
Figure 5:
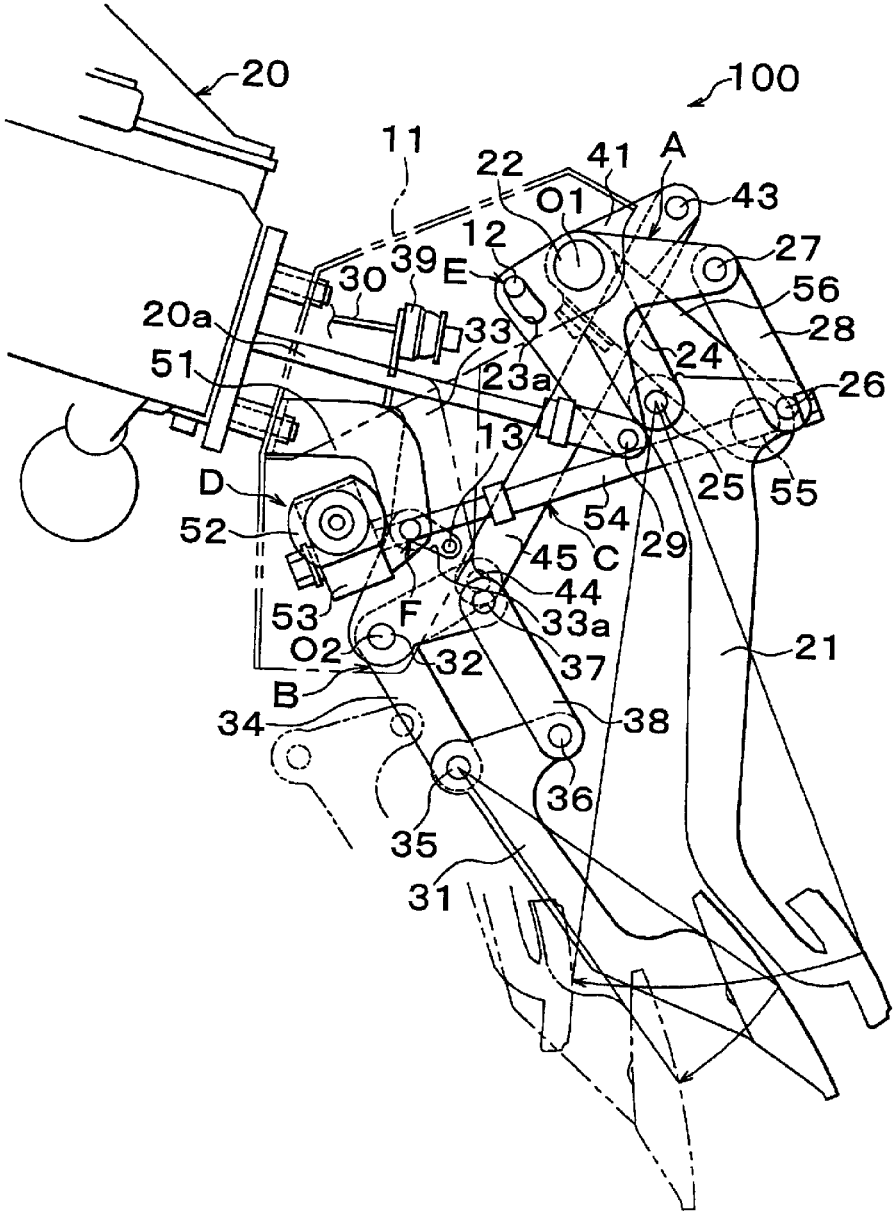
FIG. 5 is an explanatory drawing for adjustment action of the pedal apparatus shown in FIG. 2.

Further, the pedal apparatus 100 is provided with a stopper mechanism E for the operation lever 23 of the brake pedal for prescribing an allowable rotational range of the operation lever 23 in the parallel link mechanism A for brake pressure, and a stopper mechanism F for the operation lever 33 of the accelerator for prescribing an allowable rotational range of the operation lever 33 in the parallel link mechanism B. Each stopper mechanism E, F is, as shown in FIGS. 2 and 4, comprises arc grooves 23*a*, 33*a* provided at each of the operation levers 23, 33, and stopper pins 12, 13 fixed to the bracket 11 and inserted into the arc groove 23*a*, 33*a*.

Each arc groove 23*a*, 33*a* is formed in an arc shape centered around rotational operation centers O1, O2 of each operation lever 23, 33. Each stopper pin 12, 13 abuts against the end portion of each arc groove 23*a*, 33*a*, whereby an allowable rotational range of each operation lever 23, 33 is prescribed. Further, each stopper pin 12, 13 at the head thereof is provided with securing portions (circular flange portions) 12*a*, 13*a* to prevent looseness so as to restrict movement (or looseness) of each operation lever 23, 33 in the direction of plate thickness.

In the pedal apparatus according to this embodiment as above structured, an adjustment method of an initial position of the pedal by means of the adjustment mechanism D will be explained. First, the screw rod 54 is rotated by adjustment operation for normal driving or reverse driving of the motor 52 and the like in the adjustment mechanism D. Then, the nut 55 screwed onto the rod 54 moves in the direction of the rotational axis of the rod and the end portion supporting the nut of the lever arm 56 in the adjustment mechanism D swings with the center O1 of the connection axial portion 22 as the axis.

Since the lever arm 56 in the adjustment mechanism D is integrally formed with the lever arm 41 of the connection parallel link mechanism C, the lever arm 41 also swings with the center O1 of the connection axial portion 22 as the axis. The lever arm 41 is formed so as to be integrally rotated with the adjustment lever 24 for the brake pedal via the connection axial portion 22, and is rotatably attached to one end portion of the connection link 45 of the connection parallel link mechanism C. In addition, an upper end portion of the brake pedal 32 is rotatably attached to the other end portion of the adjustment lever 24 via the connection pin 25, and is connected to the connection link 28 swinging with the connection pin 26 as the axis which is rotatably attached to the bracket 11 via the connection pin 26.

Therefore, by adjustment operation of the adjustment mechanism D, the adjustment lever 24 swings, and the initial position of the brake pedal 21 is adjusted by means of the link mechanism between the adjustment lever 24 and the connection link 28.

The connection link 45 of the connection parallel link mechanism C is rotatably attached to the lever arm 41 of the parallel link mechanism A for the brake pedal, and the upper end portion of the connection link 45 swings around the connection member 22 in accordance with the swinging of the lever arm 41. Further, in accordance with the swinging of the connection link 45, the lever arm 42 of the parallel link mechanism B to be connected to the lower end portion of the connection link 45 also swings around the connection axial portion 32 of the connection parallel link mechanism C. The lever arm 42 is rotatably attached to the adjustment lever 34 for the accelerator pedal 31 centered around the connection axial portion 32.

In this case, the upper end portion of the accelerator pedal 31 is rotatably attached to the end portion of the adjustment lever 34 via the connection pin 35, and rotatably connected to the connection link 38 of the parallel link mechanism B rotatably connected to the bracket 11 via the connection pin 37. Therefore, in accordance with the swinging of the lever arm 42, an initial position of the accelerator pedal is adjusted by the link mechanism between the lever arm 42 and the adjustment lever 34.

Figure 3:
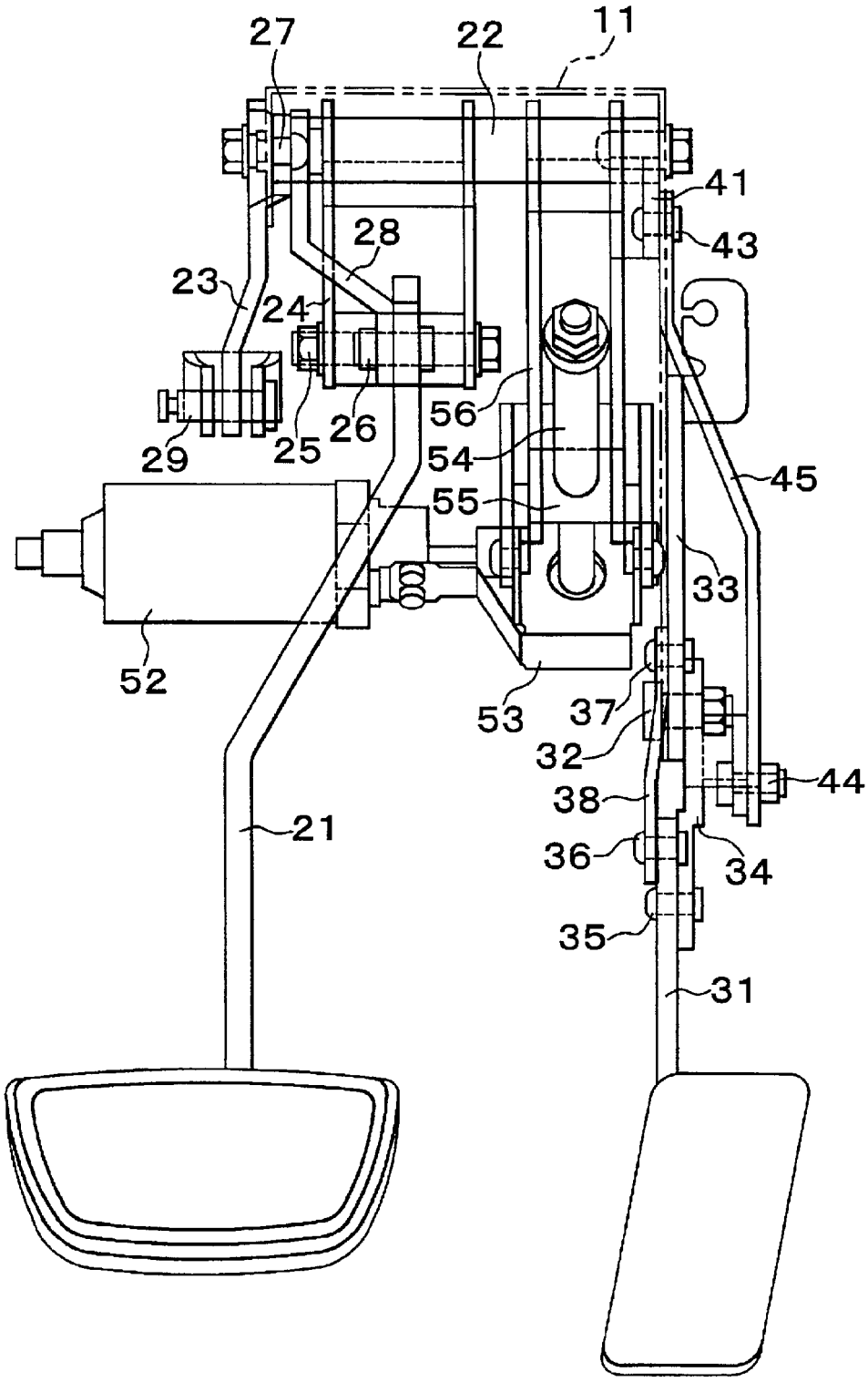
FIG. 3 is a view showing the pedal apparatus in FIG. 1, as viewed from the driver's side.

In other words, adjustment operation by means of the adjustment mechanism D enables adjusting and prescribing the forms of each parallel link mechanism A, B, and C in a range from that as shown in FIG. 2 (frontmost adjustment position) to that as shown in FIG. 3 (foremost adjustment position) so that initial positions of respective brake pedal 21 and accelerator pedal 31 can be adjusted simultaneously.

In this embodiment, both parallel link mechanisms A, B for respectively assembling the brake pedal 21 and the accelerator pedal 31 to the bracket 11 are paired and connected to each other by means of the connection parallel link mechanism C at the connection axial portions 22, 32 of both parallel link mechanisms A, B to the bracket 11 as a pair of connection portions. Thus, by setting the dimensions of each parallel link mechanism A, B optimally, the depression direction angle of the brake pedal 21 and the accelerator pedal 31 are set optimally, respectively (see arrows in FIGS. 2 and 4) (i.e. the operation feeling for each pedal is optimized), based on which, adjustment strokes of the brake pedal 21 and the accelerator pedal 31 to be adjusted simultaneously are made identical (i.e. the distance between both pedals remains unchanged).

Further, in this embodiment, an allowable rotational range of each operation lever 23, 33 rotatably operated by the brake pedal 21 and the accelerator pedal 31 is prescribed by the arc grooves 23*a*, 33*a* centered around the rotational operation centers O1, O2 provided on the operation levers 23, 33, and by the stopper pins 12, 13 fixed to the bracket 11 and inserted into the arc grooves 23*a*, 33*a*. Therefore, each stopper pin 12, 13 can prescribe an allowable rotational range (i.e. operation stroke of the pedal) of each operation lever 23, 33, enabling implementation at a low cost.

In addition, in this embodiment, each stopper pin 12, 13 at the head thereof is provided with securing portion to prevent looseness 12*a*, 13*a* of each operation lever 23, 33 in the direction of plate thickness, each securing portion to prevent looseness 12*a*, 13*a* can restrict movement of each operation lever 23, 33 in the direction of plate thickness, and rigidity of each operation lever 23, 33 in the direction of plate thickness is increased. Therefore, weight and cost can be reduced compared to when the rigidity of the operation levers 23, 33 in the direction of plate thickness is increased by increasing the plate thickness of each operation lever 23, 33.

In the above embodiment, the invention is embodied in a pedal apparatus 100 where initial positions of the brake pedal 21 and the accelerator pedal 31 can be adjusted simultaneously. However, the invention may be embodied in a pedal apparatus, for example, where, in addition to a brake pedal and the acceleration pedal, a clutch pedal and a foot rest (pedal) and the like can be adjusted simultaneously. In this case, the clutch pedal and the foot rest (pedal) and the like are also attached to the bracket via a parallel link mechanism corresponding to the parallel link mechanisms A, B, as in the case in which the brake pedal 21, and the accelerator pedal 31 and the like are attached to the bracket. This parallel link mechanism is connected to one of parallel link mechanisms for supporting the brake pedal, the acceleration pedal and the like, via a parallel link mechanism corresponding to the above connection parallel link mechanism C. In addition, the adjustment mechanism D comprising the motor 52 and the like may be disposed at an arbitrary position by means of a different connection parallel link mechanism from the connection parallel link mechanism C.

In addition, in the above embodiment, the form of each parallel link mechanism A, B, C is arbitrarily prescribed by the adjustment mechanism D comprising the motor 52, the gear box 53 for deceleration, the screw rod 54, the nut 55, the lever arm 56 and the like. However, for example, the form of each of the parallel link mechanisms A, B, C may be arbitrarily prescribed by another adjustment mechanism comprising a gear rotated centered around the rotational operation centers O1, O2 of the operation lever 23 and a driving mechanism for rotatably driving the gear. Further, based on the configuration according to the invention, the adjustment range of each pedal may be varied and the relative position of each pedal may be slightly changed at each adjustment position by making the lengths of the levers of the parallel link mechanism of each pedal different rather than identical. Similarly, it is apparent that an angle in the depressing direction of each pedal can be arbitrarily set at each adjustment position of each pedal by varying the lever lengths of the parallel link mechanisms.

What is claimed is:

1. A pedal apparatus for an automobile comprising:

a bracket fixed to a vehicle body, a first connecting portion attached to the bracket, a first parallel link mechanism rotatably attached to the bracket via the first connecting portion, a first pedal attached to the bracket via the first parallel link mechanism, a second connection portion attached to the bracket, a second parallel link mechanism rotatably attached to the bracket via the second connecting portion, a second pedal attached to the bracket via the second parallel link mechanism, a connection parallel link mechanism that connects the first parallel link mechanism and the second parallel link mechanism, the first and second connecting portions connecting both parallel link mechanisms with the bracket, and an adjustment mechanism attached to the bracket, that prescribes the first parallel link mechanism, the second parallel link mechanism, and the connection parallel link mechanism;

wherein the first parallel link mechanism and the second parallel link mechanism each comprise four connection axial portions and four link elements connecting the four connection axial portions.

2. A pedal apparatus according to claim 1, wherein the first parallel link mechanism is provided with a first adjustment lever having a first end portion and a second end portion, the first end portion of the first adjustment lever is rotatably connected to the bracket at the first connecting portion, and the second end portion of the first adjustment lever is rotatably connected to the first pedal, the second parallel link mechanism is provided with a second adjustment lever having a first end portion and a second end portion, the first end portion of the second adjustment lever is rotatably connected to the bracket at the second connecting portion, and the second end portion of the second adjustment lever is rotatably connected to the second pedal, and the connection parallel link mechanism comprises:

a first arm rotating around the first connecting portion integrally with the first adjustment lever, a second arm rotating around the second connecting portion integrally with the second adjustment lever, and a connection link for connecting the first arm and the second arm.

3. A pedal apparatus for an automobile comprising:

a bracket fixed to a vehicle body;

first and second connecting portions, attached to the bracket;

a first parallel link mechanism rotatably attached to the bracket via the first connecting portion;

a first pedal attached to the bracket via the first parallel link mechanism;

a second parallel link mechanism rotatably attached to the bracket via the second connecting portion;

a second pedal attached to the bracket via the second parallel link mechanism;

a connection parallel link mechanism that connects the first parallel link mechanism and the second parallel link mechanism, and is provided with the first and second connecting portions connecting both parallel link mechanisms with the bracket, and an adjustment mechanism attached to the bracket, that prescribes the first parallel link mechanism, the second parallel link mechanism, and the connection parallel link mechanism, wherein the first parallel link mechanism being provided with a first adjustment lever having a first end portion and a second end portion, the first end portion of the first adjustment lever being rotatably connected to the bracket at the first connecting portion, and the second end portion of the first adjustment lever is rotatably connected to the first pedal, the second parallel link mechanism being provided with a second adjustment lever having a first end portion and a second end portion, the first end portion of the second adjustment lever being rotatably connected to the bracket at the second connecting portion, and the second end portion of the second adjustment lever is rotatably connected to the second pedal, and the connection parallel link mechanism comprises:

a first arm rotating around the first connecting portion integrally with the first adjustment lever, a second arm rotating around the second connecting portion integrally with the second adjustment lever, and a connection link for connecting the first arm and the second arm, and wherein the first parallel link mechanism further comprises a first operation lever that rotates around the first connecting portion as the rotational center by operation of the first pedal and a first link that rotatably connects the first pedal and the first operation lever, respectively, the second parallel link mechanism further comprises the second operation lever that rotates around the second connecting portion the rotational center by operation of the second pedal and a second link that rotatably connects the second pedal and the second operation lever, respectively.

4. A pedal apparatus according to claim 2, wherein the adjustment mechanism prescribes the form of each parallel link mechanism and the connection parallel link mechanism by rotating the first arm of the connection parallel link mechanism around the first connecting portion.

5. A pedal apparatus for an automobile comprising:

a bracket fixed to a vehicle body;

first and second connecting portions attached to the bracket;

a first parallel link mechanism rotatably attached to the bracket via the first connecting portion;

a first pedal attached to the bracket via the first parallel link mechanism;

a second parallel link mechanism rotatably attached to the bracket via the second connecting portion;

a second pedal attached to the bracket via the second parallel link mechanism;

a connection parallel link mechanism that connects the first parallel link mechanism and the second parallel link mechanism, and is provided with the first and second connecting portions connecting both parallel link mechanisms with the bracket, and an adjustment mechanism attached to the bracket, that prescribes the first parallel link mechanism, the second parallel link mechanism, and the connection parallel link mechanism, the first parallel link mechanism being provided with a first adjustment lever having a first end portion and a second end portion, the first end portion of the first adjustment lever being rotatably connected to the bracket at the first connecting portion, and the second end portion of the first adjustment lever is rotatably connected to the first pedal, the second parallel link mechanism being provided with a second adjustment lever having a first end portion and a second end portion, the first end portion of the second adjustment lever being rotatably connected to the bracket at the second connecting portion, and the second end portion of the second adjustment lever is rotatably connected to the second pedal, and the connection parallel link mechanism comprises:

a first arm rotating around the first connecting portion integrally with the first adjustment lever, a second arm rotating around the second connecting portion integrally with the second adjustment lever, and a connection link for connecting the first arm and the second arm, wherein the adjustment mechanism prescribes each parallel link mechanism and the connection parallel link mechanism by rotating the first arm of the connection parallel link mechanism around the first connecting portion, and wherein the adjustment mechanism comprises:

a motor attached to the bracket, a screw rod attached rotatably and unmovably in the axial direction to the bracket and rotated by driving of the motor, a nut screwed onto the screw rod, and a lever arm integrally formed with the first arm of the connection parallel link mechanism, which rotatably supports the nut.

6. A pedal apparatus according to claim 1, wherein either one of the first pedal or the second pedal is an operation pedal, further comprising:

operation lever that rotates around the rotational operation center in accordance with operation of the operation pedal, and prescribing portion that prescribes an allowable rotational range of the operation lever.

7. A pedal apparatus according to claim 6, wherein the prescribing portion is provided with arc groove provided in the operation lever and centered around the rotational operation center, and stopper pin fixed to the bracket and inserted into the arc groove, and the arc groove and the stopper pin prescribe an allowable rotational range of the operation lever rotatably operated by the operation pedal.

8. A pedal apparatus for an automobile comprising:

a bracket fixed to a vehicle body;

first and second connecting portions attached to the bracket;

a first parallel link mechanism rotatably attached to the bracket via the first connecting portion;

a first pedal attached to the bracket via the first parallel link mechanism;

a second parallel link mechanism rotatably attached to the bracket via the second connecting portion;

a second pedal attached to the bracket via the second parallel link mechanism;

a connection parallel link mechanism that connects the first parallel link mechanism and the second parallel link mechanism, and is provided with the first and second connecting portions connecting both parallel link mechanisms with the bracket; and an adjustment mechanism attached to the bracket, that prescribes the first parallel link mechanism, the second parallel link mechanism, and the connection parallel link mechanism, wherein one of the first pedal or the second pedal is an operation pedal, further comprising:

an operation lever that rotates around the rotational operation center in accordance with operation of the operation pedal, and a prescribing portion that prescribes an allowable rotational range of the operation lever, wherein the prescribing portion is provided with an arc groove provided in the operation lever and centered around the rotational operation center, and a stopper pin fixed to the bracket and inserted into the arc groove, and the arc groove and the stopper pin prescribe an allowable rotational range of the operation lever rotatably operated by the operation pedal, wherein the operation lever is rotatably operated by the first pedal, and the first connecting portion is the rotational operation center of the operation lever.

9. A pedal apparatus according to claim 7, wherein the operation lever is rotatably operated by the second pedal, and the second connecting portion is the rotational operation center of the operation lever.

10. A pedal apparatus according to claim 7, further comprising:

securing portion provided at the head of the stopper pin so as to restrict movement of the operation lever in the direction of plate thickness.

* * * * *